US008001675B2

(12) United States Patent
Sugino et al.

(10) Patent No.: US 8,001,675 B2
(45) Date of Patent: Aug. 23, 2011

(54) APPARATUS FOR MANUFACTURING HEAT EXCHANGER

(75) Inventors: Yuji Sugino, Nishio (JP); Hiroyuki Nakamura, Nukata-gun (JP); Motohiro Shirai, Okazaki (JP)

(73) Assignee: Denso Corporation, Kariya (JP)

( * ) Notice: Subject to any disclaimer, the term of this patent is extended or adjusted under 35 U.S.C. 154(b) by 704 days.

(21) Appl. No.: 12/157,591

(22) Filed: Jun. 11, 2008

(65) Prior Publication Data

US 2008/0307650 A1 Dec. 18, 2008

(30) Foreign Application Priority Data

Jun. 12, 2007 (JP) ..... 2007-154978

(51) Int. Cl.
*B21D 53/02* (2006.01)
*B23P 15/26* (2006.01)

(52) U.S. Cl. ..... 29/726; 29/890.03

(58) Field of Classification Search ..... 29/726, 29/890.03, 890.052, 890.06, 890.07; 34/85, 34/576–577; 118/67, 69; 165/DIG. 514
See application file for complete search history.

(56) References Cited

U.S. PATENT DOCUMENTS 6,308,527 B1 10/2001 Kuroyanagi et al.
6,514,340 B1 * 2/2003 Momose et al. ..... 118/58

FOREIGN PATENT DOCUMENTS

| | | |
|---|---|---|
| JP | 61-149794 | 7/1986 |
| JP | 2000-176354 | 6/2000 |
| JP | 2000-179988 | 6/2000 |
| JP | 2005-036161 | 2/2005 |
| JP | 2005-313062 | 11/2005 |
| JP | 2005-321166 | 11/2005 |
| JP | 2006-125659 | 5/2006 |

OTHER PUBLICATIONS

Office action dated Mar. 17, 2009 in Japanese Application No. 2007-154978.
Office action dated Jul. 27, 2009 in corresponding Korean Application No. 10-2008-0053575.
Decision of Final Rejection dated Feb. 11, 2010 in corresponding Korean Application No. 10-2008-0053575.

* cited by examiner

*Primary Examiner* — David P Bryant
*Assistant Examiner* — Alexander P Taousakis
(74) *Attorney, Agent, or Firm* — Harness, Dickey & Pierce, PLC

(57) ABSTRACT

In a heat exchanger, a liquid resin is applied to an outer surface of the heat exchanger, and then surplus liquid resin is removed from the outer surface. In removing the surplus liquid resin, before air having a first velocity is directed to the heat exchanger for blowing the surplus liquid resin off the heat exchanger, air having a second velocity lower than the first velocity is directed to the heat exchanger to remove the surplus liquid resin from the heat exchanger by moving the surplus liquid resin along the outer surface of the heat exchanger. The air at the second velocity is directed toward the heat exchanger by a second blower before the air at the first velocity is directed toward the heat exchanger by a first blower.

4 Claims, 5 Drawing Sheets

APPARATUS FOR MANUFACTURING HEAT EXCHANGER

CROSS REFERENCE TO RELATED APPLICATION

This application is based on Japanese Patent Application No. 2007-154978 filed on Jun. 12, 2007, the disclosure of which is incorporated herein by reference.

FIELD OF THE INVENTION

The present invention relates to a method of manufacturing a heat exchanger and an apparatus for manufacturing a heat exchanger.

BACKGROUND OF THE INVENTION

In general, a heat exchanger for cooling air in a vehicular air conditioning apparatus has tubes, a first tank, a second tank and fins. The first tank is coupled to first ends of the tubes for introducing an internal fluid, such as a refrigerant, into the tubes. The second tank is coupled to second ends of the tubes for collecting the internal fluid from the tubes. The internal fluid is evaporated while flowing through the tubes by receiving heat from an external fluid flowing outside of the tubes, such as air. The fins are joined to outer surfaces of the tubes for improving efficiency of heat exchange between the internal fluid and the external fluid. Such a heat exchanger is, for example, described in Japanese Unexamined Patent Application Publication No. 2000-179988.

For example, a heat exchanger has a resin coating. In forming the resin coating in a manufacturing process, the first and second tanks, the tubes and the fins are assembled first, and then the assembled heat exchanger is immersed in a liquid resin tank. Next, the heat exchanger is removed from the liquid resin tank. In this condition, surplus liquid resin remains on the outer surface, such as the outer surfaces of the fins.

Thereafter, air is applied to the heat exchanger by a blower for removing the surplus liquid resin, thereby forming the resin coating having uniform thickness. In applying the air by the blower, if the velocity of the air is high, the surplus liquid resin is likely to be splashed due to air pressure when a flow direction of the air is changed by colliding with the heat exchanger.

If the splashed liquid resin sticks to the blower and is cured on the blower, the blower will be broken. Also, the splashed liquid resin may stick to surrounding walls. If the resin comes off from the surrounding walls, it may stick to the heat exchanger.

SUMMARY OF THE INVENTION

The present invention is made in view of the foregoing matter, and it is an object of the present invention to provide a method of manufacturing a heat exchanger, the method being capable of reducing surplus liquid resin from splashing due to air blown by a blower. It is another object of the present invention to provide an apparatus for manufacturing a heat exchanger, the apparatus capable of reducing surplus liquid resin from splashing due to air blown by a blower.

According to an aspect of the present invention, a method of manufacturing a heat exchanger includes applying a liquid resin to an outer surface of the heat exchanger and removing surplus liquid resin from the outer surface of the heat exchanger. The removing includes directing a first air having a first velocity toward the heat exchanger for blowing the surplus liquid resin off the outer surface of the heat exchanger and directing a second air having a second velocity toward the heat exchanger for removing the surplus liquid resin from the heat exchanger by moving the surplus liquid resin along the outer surface of the heat exchanger. The second velocity is lower than the first velocity. The directing of the second air is performed before the directing of the first air.

Accordingly, the amount of the surplus liquid resin is reduced by the directing of the second air, which has the velocity lower than that of the first air, before the first air is directed toward the heat exchanger. Therefore, splashing of the surplus liquid resin by air is reduced.

According to another aspect of the present invention, an apparatus for manufacturing a heat exchanger includes a first blower capable of directing a first air having a first velocity toward the heat exchanger and a second blower capable of directing a second air having a second velocity toward the heat exchanger before the first air is directed toward the heat exchanger by the first blower. The second velocity is lower than the first velocity. Surplus liquid resin applied to an outer surface of the heat exchanger is almost removed from the heat exchanger by being moved along the outer surface of the heat exchanger due to the second air, and then remaining surplus liquid resin is blown off the outer surface by the first air having the first velocity higher than the second velocity.

Accordingly, since the amount of the surplus liquid resin is reduced by the second air having the velocity lower than that of the first air, before the first air is directed toward the heat exchanger, splashing of the surplus liquid resin is reduced.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENT

Figure 1:
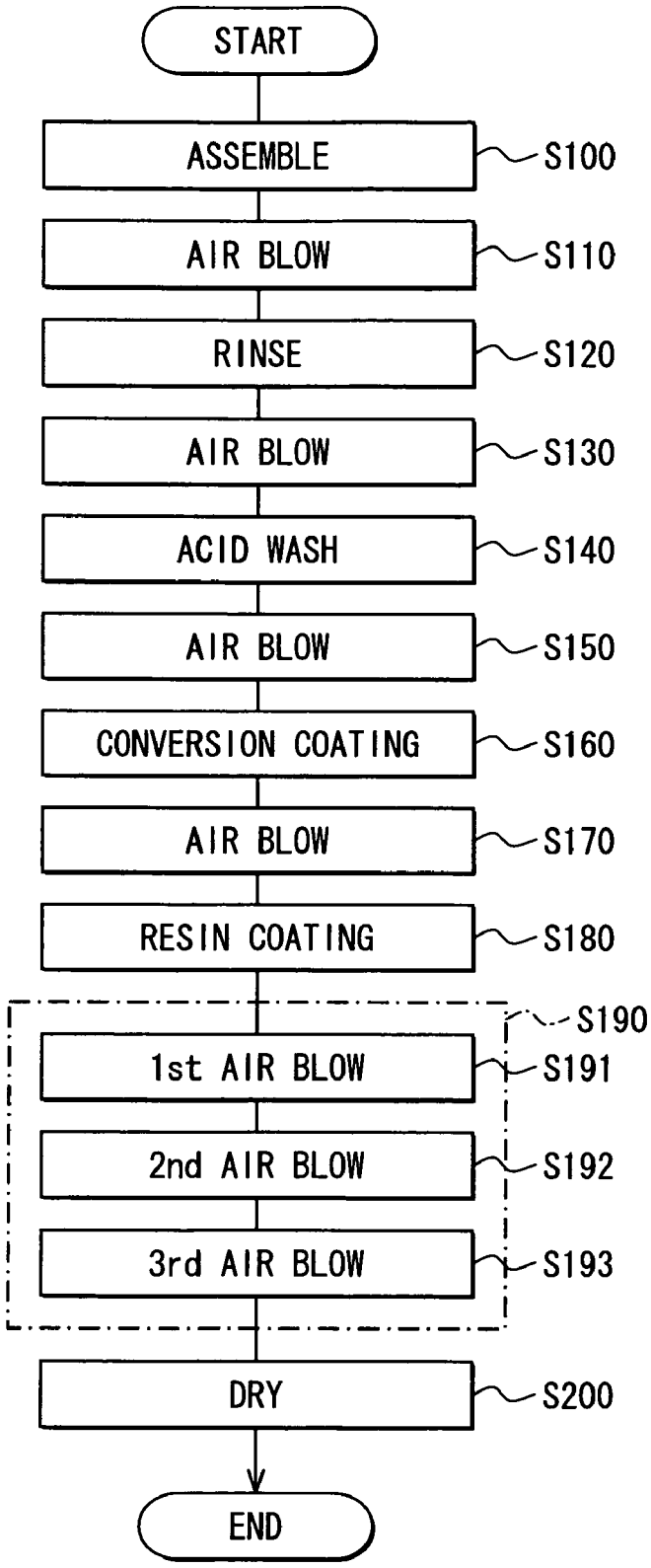
FIG. 1 is a flowchart showing a process of manufacturing an evaporator according to a first embodiment of the present invention.

A first embodiment of the present invention will now be described with reference to FIGS. 1 to 5C. FIG. 1 shows a process of manufacturing a heat exchanger.

Figure 2:
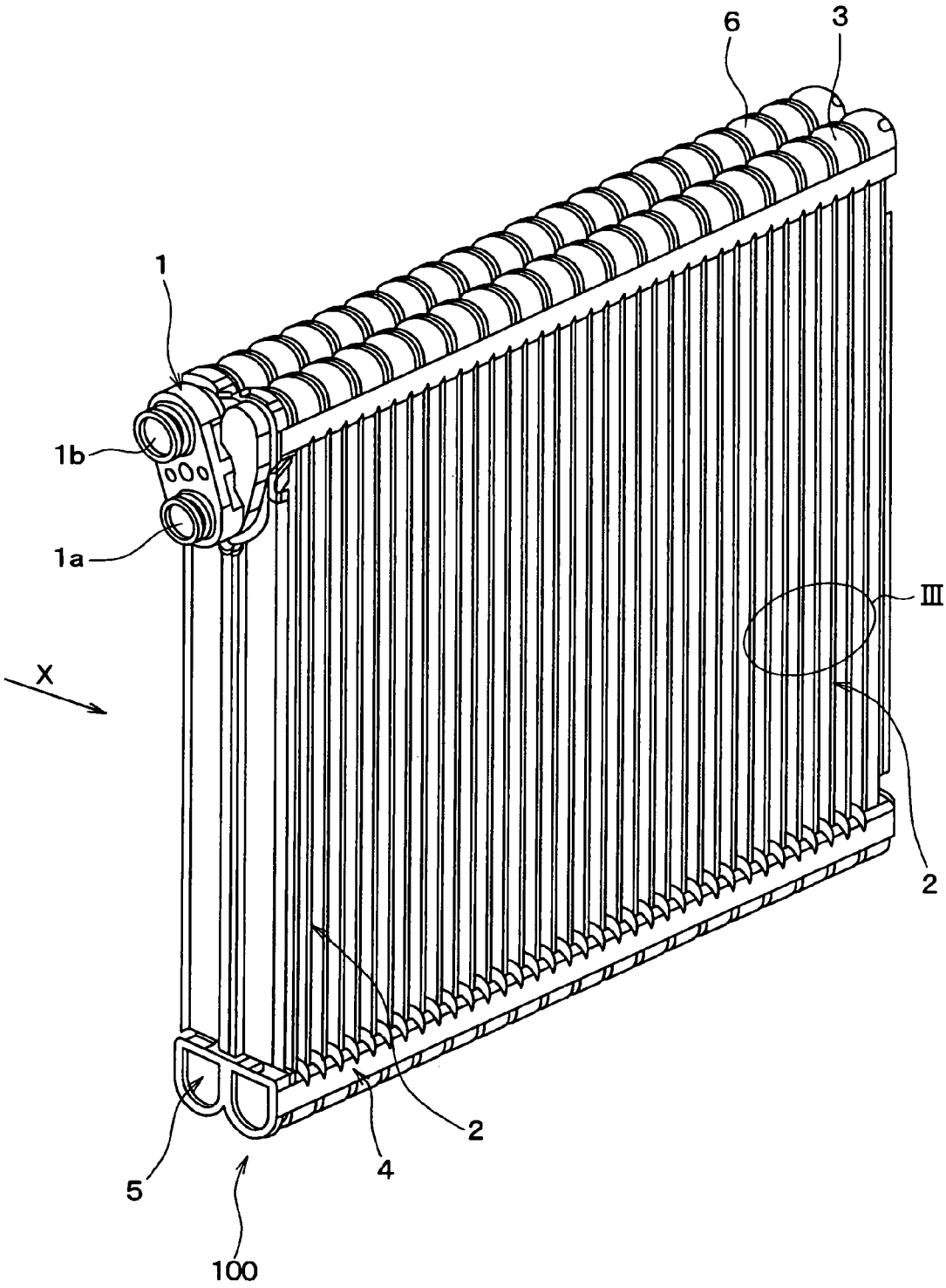
FIG. 2 is a perspective view of the evaporator according to the first embodiment.

In the present embodiment, a method of manufacturing a heat exchanger is exemplarily employed for manufacturing an evaporator 100 shown in FIG. 2. Prior to description of the method of manufacturing the evaporator 100, a structure of the evaporator 100 will be described with reference to FIG. 2.

The evaporator 100 is a heat exchanger for cooling air, and constitutes a refrigerant cycle apparatus with an expansion valve (not shown), a compressor (not shown) and the like. The evaporator 100 is provided with a connection block 1 that has a refrigerant inlet 1*a* for introducing a refrigerant into the evaporator 100 and a refrigerant outlet 1*b* for discharging the refrigerant from the evaporator 100. The refrigerant inlet 1*a* is in communication with the expansion valve such that the refrigerant discharged from the expansion valve is introduced into the evaporator 100. The refrigerant outlet 1*b* is in communication with the compressor for introducing the refrigerant discharged from the evaporator 100 to the compressor.

The evaporator 100 generally includes tubes 2, fins 7 and tank parts, such as a first upper tank part 3, a first lower tank part 4, a second lower tank part 5 and a second upper tank part 6. The tubes 2 are arranged in parallel with each other. Further, the tubes 2 are arranged in two rows, such as in an air-upstream row and an air-downstream row. The air-downstream row is disposed downstream of the air-upstream row with respect to an air flow direction X. The tubes 2 of the air-upstream row are hidden by the tubes 2 of the air-downstream row. For example, each tube 2 of the air-downstream row is overlapped with the tube 2 of the air-upstream row with respect to the air flow direction X.

The first upper tank part 3 is joined to first ends, such as upper ends in FIG. 2, of the tubes 2 of the air-downstream row. The first upper tank part 3 is in communication with the refrigerant inlet 1*a*. The refrigerant is introduced in the first upper tank part 3 from the refrigerant inlet 1*a* and is then distributed between the tubes 2 of the air-downstream row from the first upper tank part 3. The first lower tank part 4 is joined to second ends, such as lower ends in FIG. 2, of the tubes 2 of the air-downstream row. The refrigerant passing through the tubes 2 of the air-downstream row is collected in the first lower tank part 4.

The second lower tank part 5 is joined to second ends, such as lower ends in FIG. 2, of the tubes 2 of the air-upstream row. The refrigerant collected in the first lower tank part 4 is introduced in the second lower tank part 5 and is then distributed between the tubes 2 of the air-upstream row from the second lower tank part 5. The second upper tank part 6 is joined to first ends, such as upper ends in FIG. 2, of the tubes 2 of the air-upstream row. The second upper tank part 6 is in communication with the refrigerant outlet 1*b*. The refrigerant passing through the tubes 2 of the air-upstream row is collected in the second upper tank part 6. Further, the refrigerant collected in the second upper tank part 6 is discharged from the evaporator 100 through the refrigerant outlet 1*b*.

Figure 3:
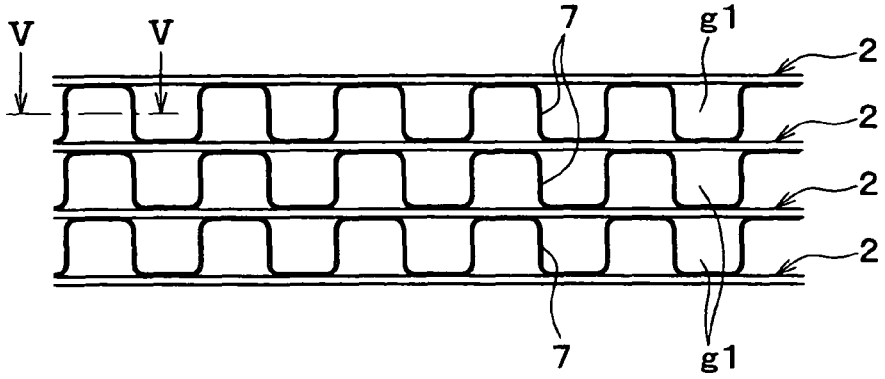
FIG. 3 is an enlarged view of a part III of the evaporator shown in FIG. 2.

As shown in FIG. 3, air passages g1 are provided between the adjacent tubes 2. The fins 7 are disposed between the tubes 2. The fins 7 are joined to outer surfaces of the tubes 2 for facilitating heat exchange between the refrigerant flowing inside of the tubes 2 and the air. In the present embodiment, the fins 7 are, for example, corrugate fins having a corrugate shape.

For example, the connection block 1, the tubes 2, the tank parts 3, 4, 5, 6 and the fins 7 are made of aluminum alloy.

On an outer surface of the evaporator 100, a resin coating having uniform thickness is formed. The resin coating serves to restrict water from splashing by a decrease in surface tension and to provide resistance to rust. Also, the resin coating serves to reduce occurrence of offensive odor, and may serve any other functions Next, the method of manufacturing the evaporator 100 will be described with reference to FIG. 1.

At S100, the connection block 1, the tubes 2, the tank parts 3, 4, 5, 6 and the fins 7 are preliminarily assembled and then integrally brazed. In this condition, the evaporator 100 is work in process, and hereinafter is referred to as the work.

At S110, air is blown toward the work by a blower to blow dust and the like off the work. At S120, the work is rinsed by water. At S130, air is blown toward the work by a blower to blow the water away.

At S140, the work is washed by acid liquid to remove flux and the like from the work. At S150, air is blown toward the work, which has been acid-washed, by a blower to blow the acid liquid away.

At S160, a metallic coating as inorganic substance is formed on an outer surface of the work (i.e., conversion coating). The metallic coating provides resistance to rust. At S170, air is blown toward the work, on which the metallic coating has been formed, by a blower to blow dust and the like away.

At S180, a liquid resin is applied to the outer surface of the work to coat the work with the liquid resin. For example, the work is soaked in a liquid resin tank. At S190, surplus liquid resin is removed from the outer surface of the work. Thus, a liquid resin coating having uniform thickness is formed on the outer surface of the work. The removing of the surplus liquid resin at S190 will be described later in detail.

At S200, the work from which the surplus liquid resin has been removed is heated to dry the liquid resin film. By the heating, the liquid resin is cross-linked on the outer surface of the work, and thus a resin coating is formed on the outer surface of the work.

Figure 4:
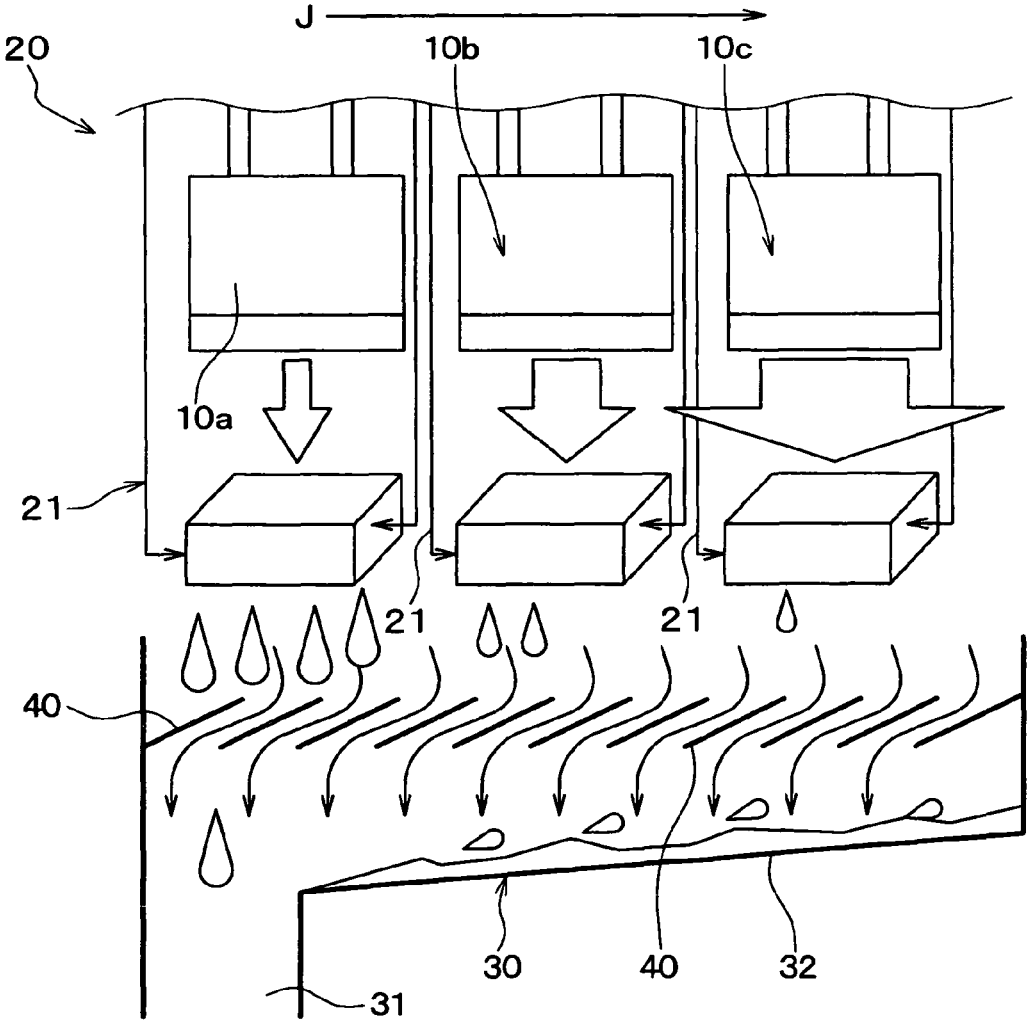
FIG. 4 is a schematic view of an apparatus for manufacturing the evaporator according to the first embodiment.

Next, a structure of an apparatus 20 for removing the surplus liquid resin from the work will be described with reference to FIG. 4.

The apparatus 20 has electric blowers 10*a*, 10*b*, 10*c*. The blowers 10*a*, 10*b*, 10*c* hang from a top, such as from a ceiling of the apparatus 20, to generate air flow in a downward direction. The blowers 10*a*, 10*b*, 10*c* are aligned in a predetermined direction J in this order.

The blowers 10*a*, 10*b*, 10*c* are disposed to direct air toward the work. Velocity Ha of air generated by the blower 10*a* is lower than velocity Hb of air generated by the blower 10*b*. Velocity Hc of air generated by the blower 10*c* is higher than the velocity Hb. (Ha<Hb<Hc)

The apparatus 20 has a receiver 30 under the blowers 10*a*, 10*b*, 10*c* for receiving the surplus liquid resin removed from the work. For example, the receiver 30 has a generally plate or container shape. The receiver 30 has a bottom wall and a collection port 31. The bottom wall 32 is gradually sloped downward toward the collection port 31.

The apparatus 20 further has splash restricting plates 40 as a splash restricting member for restricting the liquid resin from splashing from the receiver 30 toward the work. The splash restricting plates 40 are arranged at predetermined intervals and are inclined relative to an up and down direction. In the present embodiment, the splash restricting plates 40 are inclined at the same angle. For example, the splash restricting plates 40 are supported through a side wall of the receiver 30.

In the removing of the surplus liquid resin, the work passes under the blowers 10*a*, 10*b*, 10*c* in a condition supported by a support member 21. For example, the support member 21 is a hanger 21, and the work is hung by the hanger 21 such that a longitudinal direction of the tubes 2 is parallel to a horizontal direction. In this condition, the work has the liquid resin on its outer surface since it has been immersed in the liquid resin at S180.

When the work is carried under the blower 10*a*, the work receives air from the blower 10*a*, corresponding to S191 (e.g., first air blow). Thus, the surplus liquid resin on the outer surface of the work flows down.

Figure 5A:
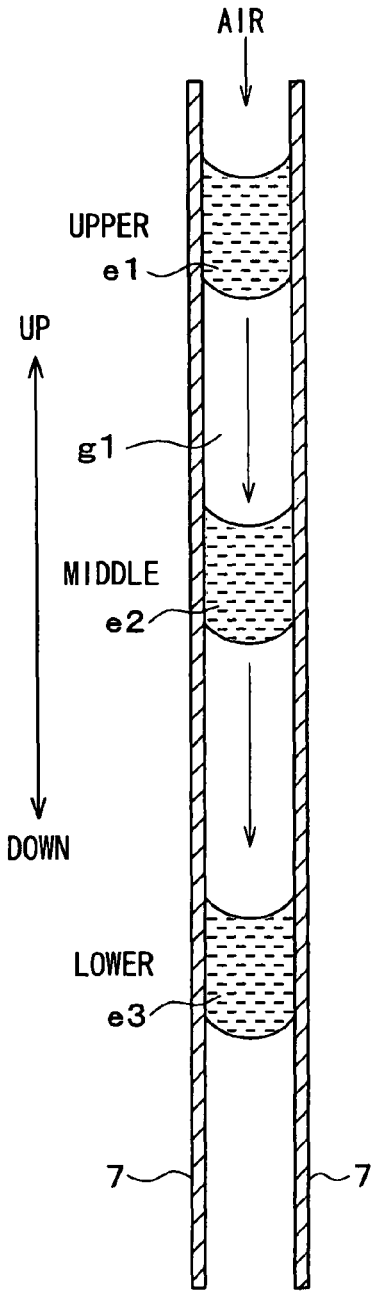
FIGS. 5A to 5C are explanatory views for explaining a mechanism of flow of a liquid resin on an outer surface of a fin of the evaporator according to the first embodiment.
Figure 5B:
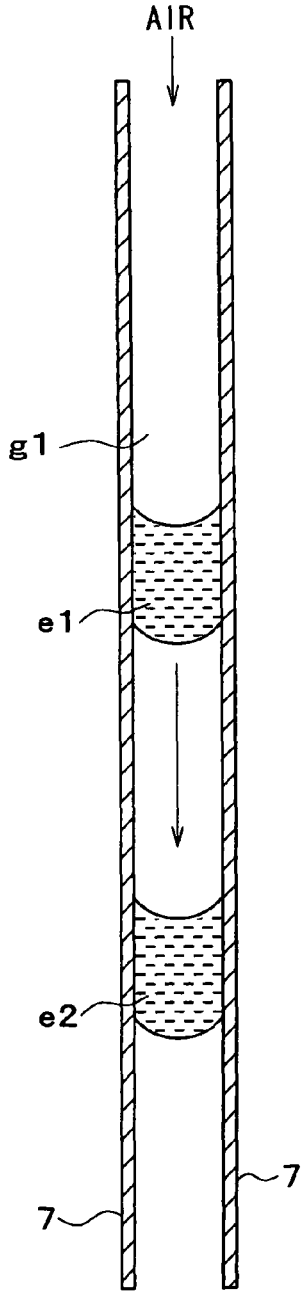
Figure 5C:
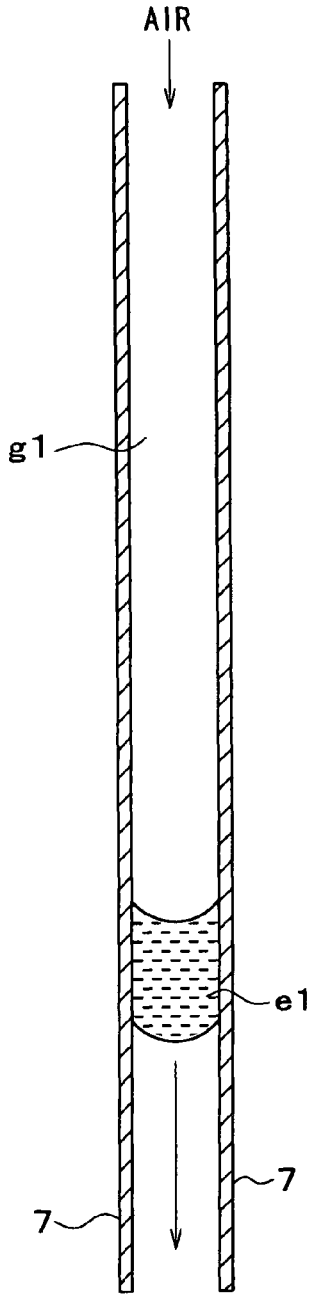

A mechanism of flow of the liquid resin on the outer surface of the work will be described with reference to FIGS. 5A to 5C. Here, the flow of the liquid resin on the outer surface of the fin 7 is described as an example. FIGS. 5A to 5C show a cross-section of the fin 7 taken along a line V-V in FIG. 3.

FIG. 5A shows a condition before the fin 7 receives the air. As shown in FIG. 5A, before the air is supplied, surplus liquid resin e1, e2, e3 are separately stuck to the outer surface of the fin 7 due to surface tension.

When the air is directed by the blower 10*a* toward the work in which the liquid resin e1, e2, e3 are separately stuck, the liquid resin e1, which is on an upper position, moves downward along the outer surface of the fin 7.

Although the liquid resin e1 merges once with the liquid resin e2, which is on a middle position, the merged liquid resin e1, e2 is divided by its own weight. Thus, the liquid resin e2 moves downward along the outer surface of the fin 7, as shown in FIG. 5B. Namely, the liquid resin e2 is replaced by the liquid resin e1, and thus the liquid resin e2 moves down.

Then, the liquid resin e1, which is on the middle position, moves down by the air generated by the blower 10*a*. Although the liquid resin e1 once merges with the liquid resin e2, which is on the lower position, the merged liquid resin e1, e2 is divided by its own weight, and the divided liquid resin e2 moves down along the outer surface of the fin 7, as shown in FIG. 5C. Namely, the liquid resin e2 is replaced by the liquid resin e1, and the liquid resin e2 moves down by its own weight.

In this way, the liquid resin e1, e2, e3 sequentially moves downward along the outer surface of the fin 7 and drop from the fin 7.

Likewise, the surplus liquid resin on outer surfaces of the connection block 1, the tubes 2 and the tank parts 3, 4, 5, 6 sequentially flow down along the outer surfaces thereof and drop from the outer surfaces.

Accordingly, the surplus liquid resin can be removed from the fins 7, the connection block 1, the tubes 2 and the tank parts 3, 4, 5, 6.

Next, the work is moved under the blower 10*b*, the work receives air from the blower 10*b*, corresponding to S192 (e.g., second air blow). Thus, the surplus liquid resin remaining the outer surface of the work flows down.

Here, the liquid resin flows off the work in the similar mechanism as discussed above. However, the velocity of air generated by the blower 10*b* is higher than that of the blower 10*a*. Although the amount of surplus liquid resin on the work has been reduced by the first air blow at S191, since the air pressure applied to the liquid resin by the blower 10*b* is higher than that by the blower 10*a*, the surplus liquid resin, which has not been removed by the first air blow at S191, can be moved down and removed from the work.

Next, when the work is carried under the blower 10*c*, the work receives air from the blower 10*c*, corresponding to S193 (e.g., third air blow). As such, the liquid resin attached to the outer surface of the work is replaced by the air generated by the blower 10*c*, and thus the surplus liquid resin is blown off the work. It is noted that the surplus liquid resin blown by the air generated by the blower 10*c* will not splash toward surrounding walls because the surplus liquid resin had been almost removed from the work by the first and second air blows at S191, S192.

Accordingly, the liquid resin coatings having uniform thickness are formed on the outer surfaces of the fins 7, the connection block 1, the tubes 2 and the tank parts 3, 4, 5, 6.

The surplus liquid resin, which has been removed from the work by the air from the blowers 10*a*, 10*b*, 10*c*, passes through the clearances provided between the splash restricting plates 40 and drops on the bottom wall 32 of the receiver 30. The dropped liquid resin flows toward the collection port 31 along the sloped bottom wall 32. The collected liquid resin is returned to the tank.

When the surplus liquid resin falls on the bottom wall 32 of the receiver 30 through the clearances provided between the splash restricting plates 40, it may splash on the bottom wall 32. At this time, the splash restricting plates 40 restrict the splashed liquid resin from flying up toward the work.

In the removing of the surplus liquid resin of the present embodiment, the air having the low velocity Ha and the air having the middle velocity Hb are applied to the work before the air having the high velocity Hc is applied to the work. That is, the removing of the surplus liquid resin includes the directing the air toward the work at a lower velocity (S191, S192), and the directing the air toward the work at a higher velocity (S193). The directing of the air at the lower velocity is performed before the directing of the air at the higher velocity.

By the directing of the air at the lower velocity, the surplus liquid resin is moved along the outer surface of the work and is dropped from the work. By the directing of the air at the higher velocity, the remaining surplus liquid resin is blown off the outer surface of the work. Thus, the amount of surplus liquid resin on the outer surface of the work is reduced before the air is applied to the work at the higher velocity by the blower 10*c*. Thus, even when the air having the higher velocity is applied to the work by the blower 10*c*, it is less likely that the liquid resin will be scattered or splashed on the work by the air.

In the directing of the air at the lower velocity, the air having the low velocity Ha is applied to the work by the blower 10*a* before the air having the middle velocity Hb is applied to the work by the blower 10*b*. That is, since the directing of the air at the lower velocity includes two air blow steps S191, S192, the surplus liquid resin is effectively drained from the work.

The air is applied to the work by the blowers 10*a*, 10*b*, 10*c* in the condition that the work is held such that the longitudinal direction of the tubes 2 is parallel to the horizontal direction. That is, the air is blown to the work in the condition that the air passages g1 between the tubes 2, that is, passages defined between the fins 7, extend in the up and down direction. The liquid resin moves downward by receiving the air from the blowers 10*a*. 10*b*, 10*c*.

On the other hand, if the work is held such that the longitudinal direction of the tubes 2 is parallel to the up and down direction when the air is directed, the following drawbacks arise.

When the work is situated such that the longitudinal direction of the tubes 2 is parallel to the up and down direction after being removed from the liquid resin tank, the liquid resin applied to the outer surface of the work almost moves down by its own weight. In this case, however, it is necessary to direct the air from the blowers 10*a*, 10*b*, 10*c* in the horizontal direction. Particularly, the liquid resin blown by the blower 10*c* will stick to the surrounding walls and the like. Thus, it is difficult to collect the surplus liquid resin.

In the present embodiment, since the air from the blowers 10*a*, 10*b*, 10*c* is directed to the work in the downward direction and the liquid resin falls down, it is easy to collect the removed liquid resin.

Further, the bottom wall 32 of the receiver 30 gradually slopes down toward the collection port 31. Therefore, the removed liquid resin is smoothly introduced toward the collection port 31.

The amount of the surplus liquid resin removed by the first air blow at S191 is larger than the amount of the surplus liquid resin removed by the third air blow at S193. That is, the amount of the surplus liquid resin removed by the blower 10*a* is larger than the amount of the surplus liquid resin removed by the blower 10*c*.

In the present embodiment, the collection port 31 of the receiver 30 is located under the blower 10*a*. Accordingly, the surplus liquid resin removed from the work is effectively introduced to the collection port 31.

SECOND EMBODIMENT

Figure 6A:
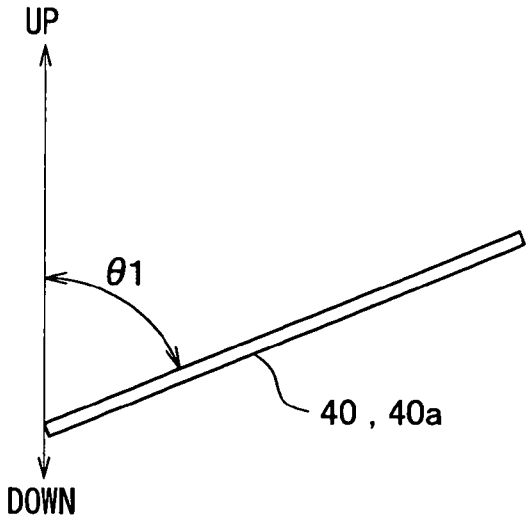
FIGS. 6A and 6B are schematic views of splash restricting plates of an apparatus for manufacturing an evaporator according to a second embodiment of the present invention.
Figure 6B:
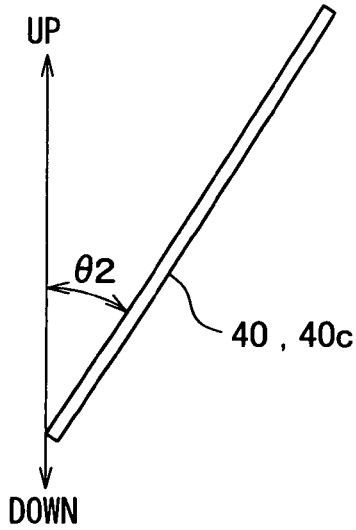

A second embodiment of the present invention will now be described with reference to FIGS. 6A and 6B. In the present embodiment, the angle of inclination of the splash restricting plates 40 is varied in accordance with the positions associated with the blowers 10*a*, 10*b*, 10*c*. FIG. 6A shows the splash restricting plate 40*a* that is located under the blower 10*a*, and FIG. 6B shows the splash restricting plate 40*c* that is located under the blower 10*c*. For example, the angle of inclination θ1 of the splash restricting plate 40*a* under the blower 10*a* is larger than angle of inclination θ2 of the splash restricting plate 40*c* under the blower 10*c*.

Here, the splash restricting plates 40*a*, 40*c* are inclined in the clockwise direction relative to the up and down direction. For example, the splash restricting plates 40*a*, 40*c* are inclined in the forward direction of the predetermined direction J, relative to the up and down direction.

The amount of the surplus liquid resin removed by the first air blow from the blower 10*a* is larger than the amount of the surplus liquid resin removed by the second air blow from the third blower 10*c*. Since the angle of inclination θ1 of the splash restricting plates 40*a* under the blower 10*a* is larger than the angle of inclination θ2 of the splash restricting plates 40*c* under the blower 10*c*, the splashing of the removed liquid resin on the bottom wall 32 is effectively restricted.

Since the angle of inclination θ2 of the splash restricting plates 40*c* under the blower 10*c* is smaller than the angle of inclination θ1 of the splash restricting plates 40*a* under the blower 10*a*, the surplus liquid resin removed by the blower 10*c* is effectively conducted to the bottom wall 32 of the receiver 30 through the clearance between the splash restricting plates 40*c*.

As the angle of inclination of the splash restricting plates 40*c* is reduced, the surplus liquid resin splashed on the bottom wall 32 more easily flies up through the clearances between the splash restricting plates 40. In fact, since the amount of the surplus liquid resin removed by the blower 10*c* is smaller than the amount of the surplus liquid resin removed by the blower 10*a*, the surplus liquid resin removed by the blower 10*c* will not substantially splash on the bottom wall 32.

OTHER EMBODIMENTS

The above method and apparatus 20 for manufacturing the heat exchanger is not limited to manufacture the evaporator 100, but may be employed to manufacture any heat exchangers.

In the second embodiment, the angle of inclination of the splash restricting plate 40 under the blower 10*b* can be also varied in accordance with the amount of the surplus liquid resin removed by the blower 10*b*.

In the above embodiments, the work is held such that the longitudinal direction of the tubes 2 is parallel to the horizontal direction when being supplied with the air from the blowers 10*a*, 10*b*, 10*c*. However, depending on the structure of the fins 7 and the air passages g1, the work may be held in different way as long as the dropping of the surplus liquid resin is facilitated and the collecting of the surplus liquid resin removed from the work is improved.

In the above embodiments, the air is applied to the heat exchanger at three different velocities Ha, Hb, Hc. However, the velocity of the air applied to the heat exchanger may be differentiated at least two or more than two levels. Further, the airs having different velocities may be generated by varying the velocities by one blower.

Additional advantages and modifications will readily occur to those skilled in the art. The invention in its broader term is therefore not limited to the specific details, representative apparatus, and illustrative examples shown and described.

What is claimed is:

1. An apparatus for manufacturing a heat exchanger, comprising:

a first blower capable of directing a first air having a first velocity toward the heat exchanger to blow surplus liquid resin off an outer surface of the heat exchanger;

a second blower capable of directing a second air having a second velocity lower than the first velocity toward the heat exchanger to remove the surplus liquid resin from the heat exchanger by moving the surplus liquid resin along the outer surface of the heat exchanger, the second blower being configured to direct the second air toward the heat exchanger before the first blower directs the first air toward the heat exchanger;

a receiver disposed under the first and second blowers, the receiver including a bottom wall and a collection port to collect the surplus liquid resin removed from the heat exchanger, the collection port being located under the second blower; and a splash restricting member disposed between the first and second blowers and the receiver, and capable of restricting the surplus liquid resin dropped on the receiver from flying up toward the heat exchanger, the splash restricting member including a plurality of plates that are arranged at intervals and inclined relative to an up and down direction, wherein an angle of inclination of one of the plates that is located under the second blower is greater than an angle of inclination of another one of the plates that is located under the first blower.

2. The apparatus according to claim 1, further comprising:

a support member capable of supporting the heat exchanger such that a longitudinal direction of tubes of the heat exchanger is parallel to a horizontal direction, and the heat exchanger receives the first air and the second air from a top side in a condition of being supported by the support member.

3. The apparatus according to claim 1, wherein the bottom wall of the receiver is sloped down toward the collection port.

4. The apparatus according to claim 1, further comprising:

a third blower capable of directing a third air having a third velocity toward the heat exchanger after the second blower directs the second air toward the heat exchanger and before the first blower directs the first air toward the heat exchanger, the third velocity being higher than the second velocity and lower than the first velocity.

* * * * *